US006019536A

United States Patent [19]

Lee

[11] Patent Number: 6,019,536

[45] Date of Patent: Feb. 1, 2000

[54] PEN HAVING A 3-DIMENSIONAL PATTERN THEREON

[75] Inventor: Ching-Huang Lee, Sanchung, Taiwan

[73] Assignee: Ding Ares Enterprise Co., Ltd., Taiwan

[21] Appl. No.: 09/073,273

[22] Filed: May 5, 1998

[51] Int. Cl.[7] ..... B43K 23/12; B43K 23/00; B43K 29/00

[52] U.S. Cl. ..... 401/195; 40/334; 40/905; 401/88; 401/98; 401/243; 401/247

[58] Field of Search ..... 401/88, 98, 195, 401/244, 247, 243, 251; 40/334, 335, 905; 24/11 F, 11 P, 11 R; 15/435

[56] References Cited

U.S. PATENT DOCUMENTS

| | | | |
|---|---|---|---|
| D. 356,113 | 3/1995 | Maggio | 401/195 X |
| 1,961,460 | 6/1934 | Slatis | 40/334 |
| 2,896,348 | 7/1959 | Herne | 40/905 X |
| 4,926,525 | 5/1990 | Eylers | 24/11 F |
| 5,186,562 | 2/1993 | Yoshinaga et al. | 401/195 X |
| 5,735,592 | 4/1998 | Shu | 401/195 X |

FOREIGN PATENT DOCUMENTS

| | | | |
|---|---|---|---|
| 606124 | 6/1926 | France | 401/88 |
| 770358 | 9/1934 | France | 401/98 |

*Primary Examiner*—Steven O. Douglas
*Assistant Examiner*—Kathleen J. Prunner
*Attorney, Agent, or Firm*—Patterson & Keough, P.A.

[57] ABSTRACT

A pen having a 3-dimensional pattern thereon is disclosed. There is a aperture defined in a sidewall of the barrel or pen cap of the pen. A flexible strip having a 3-dimensional pattern thereon is suitably deformed and placed inside the barrel or pen cap whereby the 3-dimensional pattern of the flexible strip protrudes through the aperture. A liner ring is further plugged into the barrel or the pen cap so that the flexible strip is securely clamped between the barrel or pen cap and the liner ring. Consequently, the 3-dimensional pattern is securely fixed on the pen.

2 Claims, 4 Drawing Sheets

PEN HAVING A 3-DIMENSIONAL PATTERN THEREON

BACKGROUND OF THE INVENTION

1. Field of the Invention

The present invention relates to the field of forming a pattern on a pen; more particularly, the present invention relates to the field of forming a 3-dimensional pattern on the barrel or the cap of a pen.

2. Description of Related Art

For being attractive, a pen is usually decorated with a pattern of brand or other pretty patterns on the barrel or pen cap. The barrel of a pen usually has an arcuate surface for the convenience of being held and the corresponding pen cap also has an arcuate surface. However, due to the restriction of the technique in manufacturing the barrel or cap of a pen, it is impossible to form a 3-dimensional pattern on the arcuate surface of the barrel or cap. Therefore, the surface of a pen can be decorated with only planar patterns.

The planar pattern on a pen is not particularly eye-catching and is easily worn away. Therefore, it is preferable to have a 3-dimensional pattern on a pen. One possible solution is to attach a 3-dimensional pattern on the pen clip which is substantially the only part of the pen without an arcuate surface. As shown in FIG. 4, a 3-dimensional butterfly pattern 52 is attached to a pen clip 51 of a pen 50. However, such a 3-dimensional pattern attached on a pen clip is obtrusive to convenient use and easy to be detached from the pen. Therefore, there is a continuing need for the above pen to be improved.

SUMMARY OF THE INVENTION

The object of the present invention is to form a 3-dimensional pattern on a pen. In a preferred embodiment, a 3-dimensional pattern is formed on the pen cap of a pen. To attain this, an aperture is defined in a sidewall of the pen cap. A flexible strip having a 3-dimensional pattern thereon is suitably deformed and placed inside th e pen cap whereby the 3-dimensional pattern of the flexible strip protrudes through the aperture. A liner ring is further plugged into the pen cap so that the flexible strip is securely clamped between the pen cap and the liner ring. Consequently, the 3-dimensional pattern is securely fixed on the pen cap.

Similarly, a 3-dimensional pattern can be formed on the barrel of a pen. To attain this, an aperture is defined in a sidewall of the barrel and a suitably deformed flexible strip having the 3-dimensional pattern thereon and a liner ring are sequentially placed inside the barrel whereby the 3-dimensional pattern protrudes through the aperture and is securely clamped between the barrel and the liner ring.

DETAILED DESCRIPTION OF PREFERRED EMBODIMENT

Figure 4:
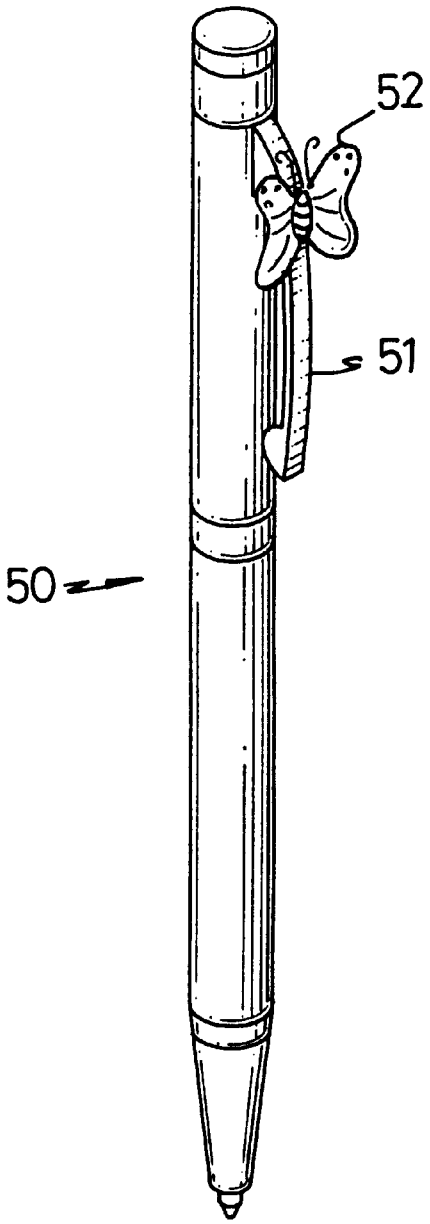
FIG. 4 PRIOR ART
FIG. 4 is a perspective view of a conventional pen.
Figure 1:
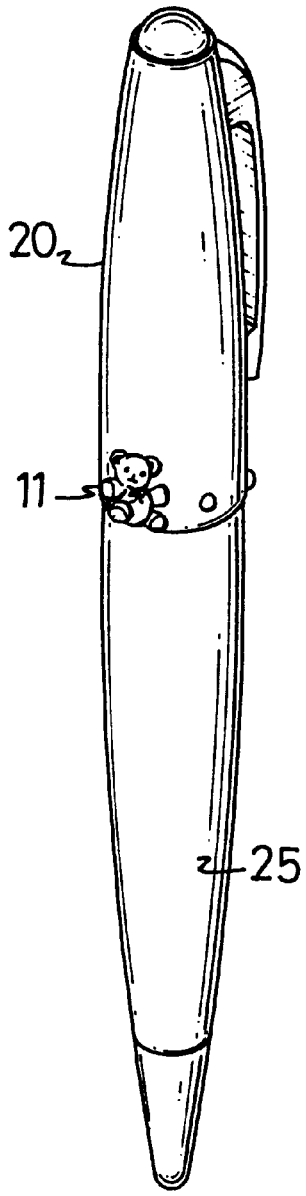
FIG. 1 is a perspective view of a pen in accordance with the present invention.

Referring to FIG. 1, a preferred embodiment of the present invention is shown to have a pen having a 3-dimensional pattern 11 thereon. The pen comprises a barrel 25 and a cap 20. The 3-dimensional pattern 11 is formed on the pen cap 20.

Figure 2:
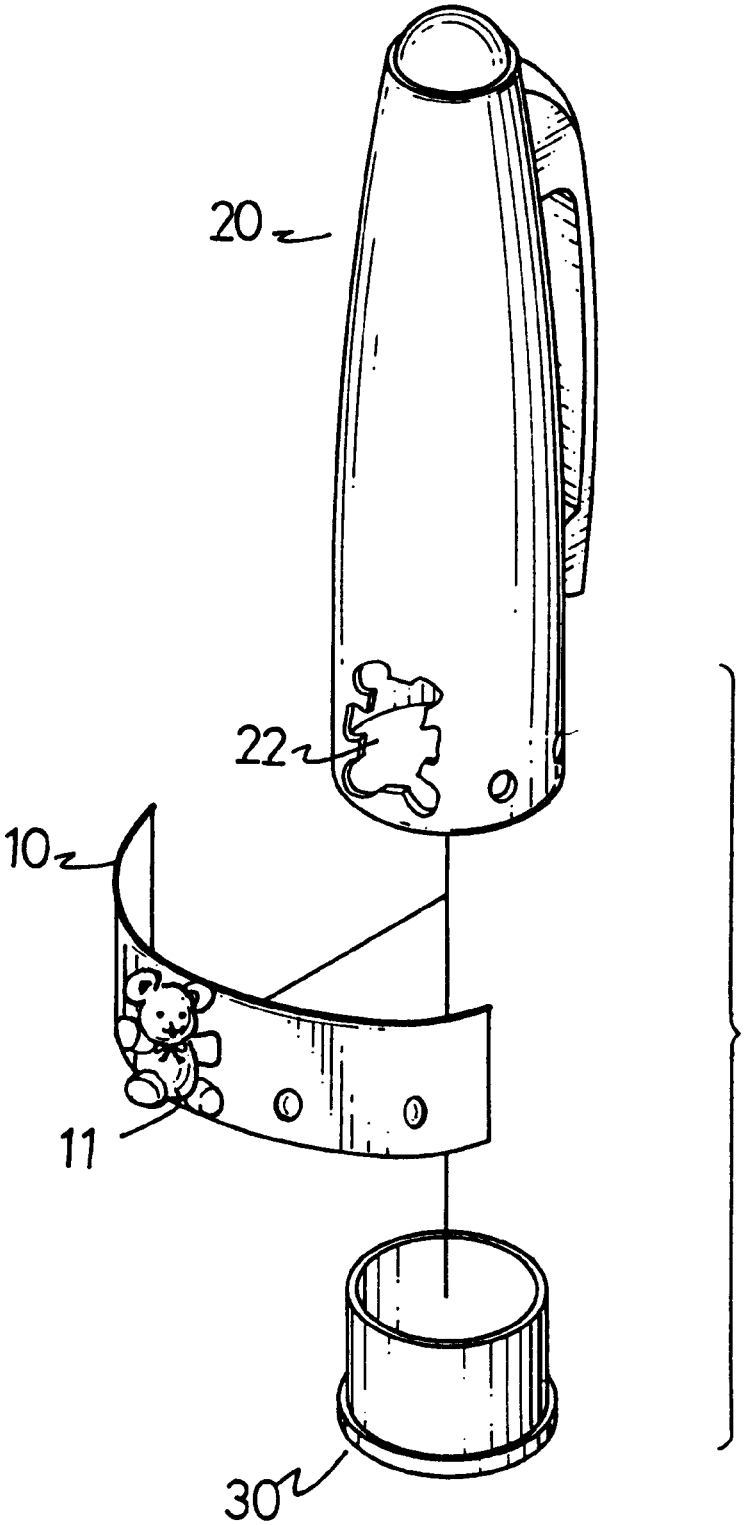
FIG. 2 is an exploded view of a pen cap in accordance with the present invention.
Figure 3:
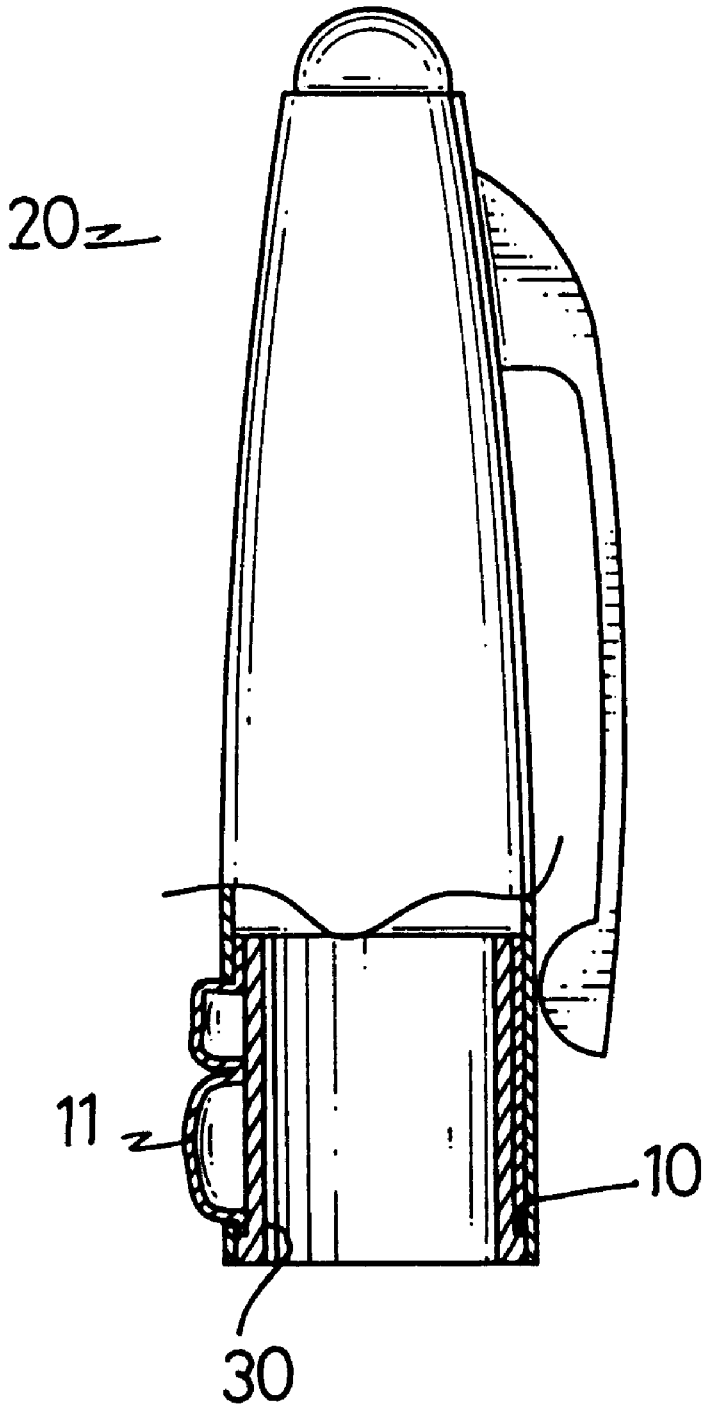
FIG. 3 is a cross-sectional view of a pen cap in accordance with the present invention.

The structure for forming the 3-dimensional pattern 11 on the pen cap 20 is shown in FIG.2 wherein a flexible strip 10 having a 3-dimensional pattern 11 is provided to the pen cap 20. A liner ring 30 is further provided to secure the flexible strip 10 within the pen cap 20. The 3-dimensional pattern 11 may be formed on the flexible strip 10 by moulding or other suitable working operations. The external diameter of the liner ring 30 is slightly smaller than the internal diameter of the pen cap 20. An aperture 22 is defined in a sidewall of the pen cap 20 and is configured to receive the 3-dimensional pattern therein such that the 3-dimentional pattern may protrude slightly from the pen cap 20 when the flexible strip 10 is deformed to be received therein. The liner ring 30 is then plugged into the pen cap 20 so that the flexible strip 10 is securely clamped between the interior surface of the pen cap 20 and the exterior surface of liner ring 30. As a result, the 3-dimensional pattern is securely fixed on the pen cap 20 as shown in FIG. 3. Moreover, an internal diameter of the liner ring 30 is slightly larger than the external diameter of the barrel 25 so that the barrel 25 can be capped by the pen cap 20 having the 3-dimensional pattern 11.

Figure 5:
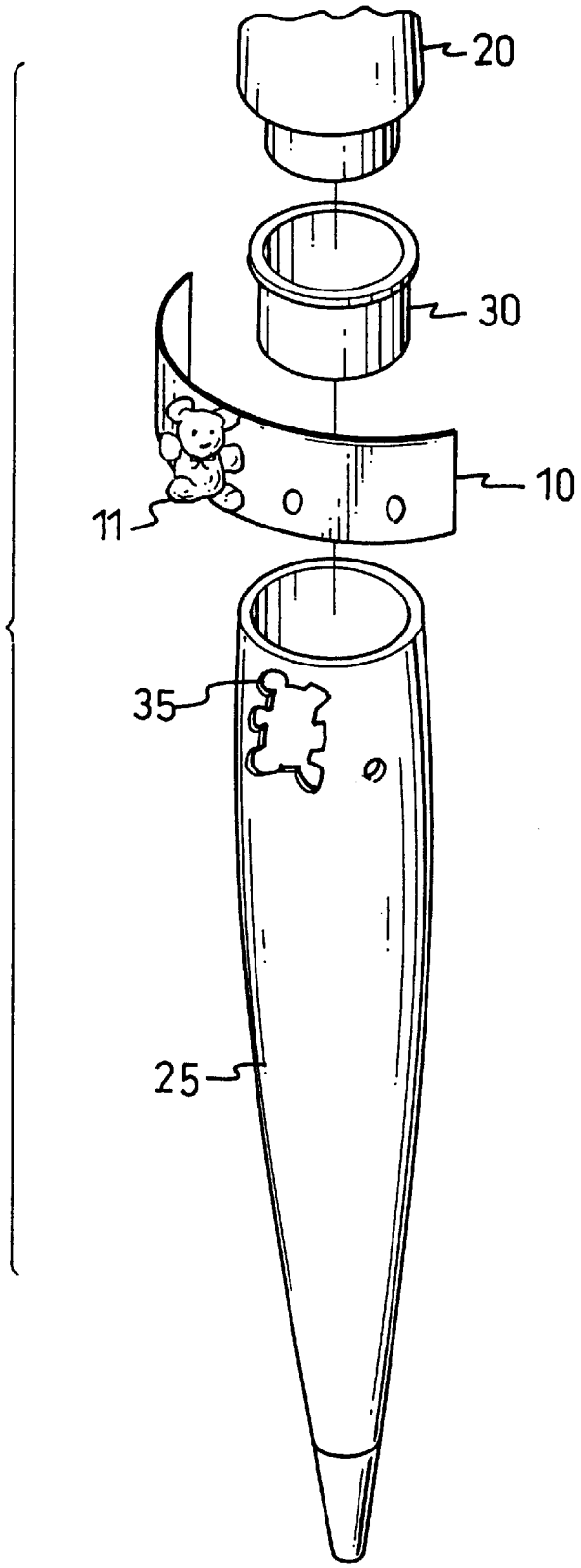
FIG. 5 is an exploded view of a pen barrel in accordance with the present invention.

In addition to forming a 3-dimensional pattern on a pen cap of a pen, the 3-dimensional pattern can be formed on the barrel of a pen. To attain this, a second aperture 35 is defined in a sidewall of the barrel 25 (FIG. 5). Similar to the above embodiment, a flexible strip 10 having the 3-dimensional pattern 11 thereon is arcuately deformed and placed inside the barrel 25 whereby the 3-dimensional pattern 11 protrudes from the barrel 25 through the aperture 35. A liner ring 30 is then further plugged into the barrel so that the flexible strip 10 is securely clamped between the interior surface of the barrel 25 and the exterior surface of liner ring 30. Consequently, the 3-dimensional pattern is securely fixed on the barrel.

What is claimed is:

1. A pen having a 3-dimensional pattern thereon, comprising:

a pen cap having a sidewall and defining an aperture in said sidewall;

a flexible strip having a 3-dimensional pattern thereon, said flexible strip being deformed and placed inside said pen cap so that said 3-dimensional pattern protrudes through said aperture; and a liner ring further plugged into said pen cap so that said flexible strip is securely clamped between, and in contact with, said pen cap and said liner ring.

2. A pen having a 3-dimensional pattern thereon, comprising:

a barrel having a sidewall and defining an aperture in said sidewall;

a flexible strip having a 3-dimensional pattern thereon, said flexible strip being deformed and placed inside said barrel so that said 3-dimensional pattern protrudes through said aperture; and a liner ring further plugged into said barrel so that said flexible strip is securely clamped between, and in contact with, said barrel and said liner ring.

* * * * *